US007438586B2

(12) United States Patent
Ju

(10) Patent No.: US 7,438,586 B2
(45) Date of Patent: Oct. 21, 2008

(54) ELECTRICAL CONNECTOR

(76) Inventor: Ted Ju, No. 15, Wu-Shiun Street, Anle District, Keelung, 204 (TW)

( * ) Notice: Subject to any disclaimer, the term of this patent is extended or adjusted under 35 U.S.C. 154(b) by 0 days.

(21) Appl. No.: 11/580,311

(22) Filed: Oct. 13, 2006

(65) Prior Publication Data

US 2008/0090462 A1 Apr. 17, 2008

(51) Int. Cl.
*H01R 4/24* (2006.01)

(52) U.S. Cl. ..... 439/398

(58) Field of Classification Search ..... 439/398, 439/700, 695, 701, 595, 289–290, 65–71, 439/91, 515, 824, 591, 500, 246–249, 482, 439/862; 267/71

See application file for complete search history.

(56) References Cited

U.S. PATENT DOCUMENTS

| | | | | |
|---|---|---|---|---|
| 3,440,596 | A * | 4/1969 | Frompovicz | 439/695 |
| 4,385,754 | A * | 5/1983 | Waite | 267/71 |
| 6,241,560 | B1 * | 6/2001 | Furusawa et al. | 439/700 |
| 7,097,485 | B1 * | 8/2006 | Wang et al. | 439/289 |

* cited by examiner

*Primary Examiner*—Edwin A. León
(74) *Attorney, Agent, or Firm*—Ming Chow; Sinorica, LLC

(57) ABSTRACT

An electrical connector is disclosed to include two conducting terminals mounted in each terminal slot of the electrically insulative housing thereof and electrically coupled together for connection to a respective external electronic member, and a spring member accommodated in an accommodation space between the two conducting terminals in each terminal slot to support the associating conducting terminals against external pressure.

51 Claims, 5 Drawing Sheets

ELECTRICAL CONNECTOR

BACKGROUND OF THE INVENTION

1. Field of the Invention

The present invention relates to an electrical connector and more particularly, to a compression contact electrical connector.

2. Description of the Related Art

A conventional compression contact electrical connector is known comprising an electrically insulative housing and a plurality of conducting terminals mounted in the electrically insulative housing. The electrically insulative housing has terminal slots. The conducting terminals are mounted in the terminal slots. China Patent No. 00217081 discloses an electrical connector of which the both ends are of compression contact type. According to this design, each conducting terminal has a positioning portion, and a contact portion at each of the two distal ends. China Patent No. 02254746 discloses an electrical connector, which has one end of compression contact type and the other end of bonding type. According to this design, each conducting terminal has a positioning portion, a contact portion at one end, and a bonding portion at the other end. In either of the aforesaid two conventional designs, each conducting terminal is stamped from a metal material in integrity. The contact portion of each conducting terminal may be plastically deformed when compressed and hit by an external object. When the contact portion is plastically deformed, it cannot return to its former shape, thereby loosening its resilience and becoming unable to contact the matching electronic member effectively. When this happens, the electrical connector cannot work normally.

Further, in order to obtain a certain resilient power, a conducting terminal may be made of a copper alloy, for example, phosphor bronze. Phosphor bronze is relatively cheap, however its conductivity is only about 20% IACS. Special copper alloy has a reasonable price, however its conductivity is about 40~60% IACS that is still not optimum. Further, copper beryllium alloy has conductivity as high as about 80% IACS, however it is expensive. Red bronze has better conductivity, however its mechanical performance cannot satisfy the demand.

Further, China Patent No. 02293473 discloses an electrical connector that eliminates some drawbacks of the aforesaid various conventional designs. According to this design, the electrical connector comprises a metal shell, probes, and spring members respectively set between the metal shell and the probes. However, this design is still not satisfactory in function. The spring members may oscillate horizontally to touch the metal shell when received a pressure. The metal shell may be forced to oscillate the probes when received a pressure in horizontal direction, affecting the connection stability of the electrical connector.

Therefore, it is desirable to provide an electrical connector that eliminates the aforesaid problem.

SUMMARY OF THE INVENTION

The present invention has been accomplished under the circumstances in view. It is one object of the present invention to provide an electrical connector, which keeps effective contact with the matching electronic members constantly.

To achieve the above object, the invention provides an electrical connector, which comprises an electrically insulative housing, which has a plurality of terminal slots, a plurality of first conducting terminals respectively mounted in the terminal slots at one side, a plurality of second conducting terminals respectively mounted in the terminal slots at the opposite side and respectively clamped on the first conducting terminals, and a plurality of spring members respectively mounted in the terminal slots and supported between the respective first conducting terminals and the respective second conducting terminals.

The spring member in each terminal slot is supported between the associating first conducting terminal and the associating second conducting terminal so that the first conducting terminal is movable vertically relative to the second and second conducting and the electrically insulative housing to prevent deformation when received an external pressure. Further, the second conducting terminal is clamped on the associating first conducting terminal so that the first conducting terminal and the associating second conducting terminal are maintained constantly electrically connected together.

The present invention also provides an electrical connector, which comprises an electrically insulative housing, which has a plurality of terminal slots, and a plurality of conducting terminal sets respectively mounted in the terminal slots. The conducting terminal sets each comprise a first conducting terminal and a second conducting terminal mounted in one of the terminal slots at two opposite sides, the second conducting terminal having two springy clamping arms clamped on the associating first conducting terminals, and an elastomer supported between the first conducting terminal and the second conducting terminal.

The present invention also provides an electrical connector, which comprises an electrically insulative housing, which has a plurality of terminal slots, a plurality of first conducting terminals respectively mounted in the terminal slots at one side, a plurality of second conducting terminals respectively mounted in the terminal slots at the opposite side and respectively clamped on the first conducting terminals, and a plurality of spring members respectively mounted in the terminal slots and supported between the respective first conducting terminals and the respective second conducting terminals, wherein the first conducting terminals and the second conducting terminals are respectively made of two different metal materials.

The spring member supports the associating first conducting terminal and the associating second conducting terminal against external pressure. Preferably, the first conducting terminals are made of a metal material having a relatively higher conductivity than the second conducting terminals, and the second conducting terminals are made of a resilient metal material.

The present invention also provides an electrical connector, which comprises an electrically insulative housing, which has a plurality of terminal slots, and a plurality of conducting terminal sets respectively mounted in the terminal slots. The conducting terminal sets each comprise a first conducting terminal and a second conducting terminal mounted in one terminal slot at two opposite sides and disposed in contact with each other, and a spring member supported between the first conducting terminal and the second conducting terminal. The electrically insulative housing has a plurality of limiters respectively provided inside the terminal slots to support the associating spring members in the terminal slots in shape and in place, preventing oscillation of the associating first conducting terminal and the associating second conducting terminal upon an external pressure.

The invention also provides an electrical connector, which comprises an electrically insulative housing, which has a plurality of terminal slots, and a plurality of conducting terminal sets respectively mounted in the terminal slots. The conducting terminal sets each comprise a first conducting terminal and a second conducting terminal mounted in one terminal slot at two opposite sides and disposed in contact with each other, and a spring member supported between the first conducting terminal and the second conducting terminal. The first conducting terminal of each conducting terminal set has a width set in the associating terminal slot in a first direction. The second conducting terminal of each said conducting terminal set has a width set in the associating terminal slot in a second direction that extends across the first direction. The first conducting terminal of each of the conducting terminal sets defines with the associating second conducting terminal an accommodation space, which accommodates the associating spring member. This, the spring member is positively supported between the associating first conducting terminal and the associating second conducting terminal.

DETAILED DESCRIPTION OF THE PREFERRED EMBODIMENT

Figure 1:
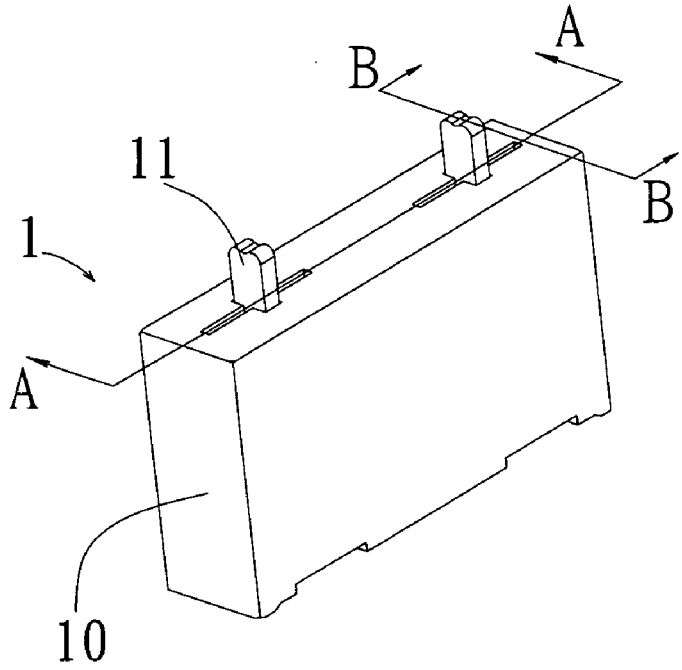
FIG. 1 is a schematic top elevation of an electrical connector according to the present invention.
Figure 2:
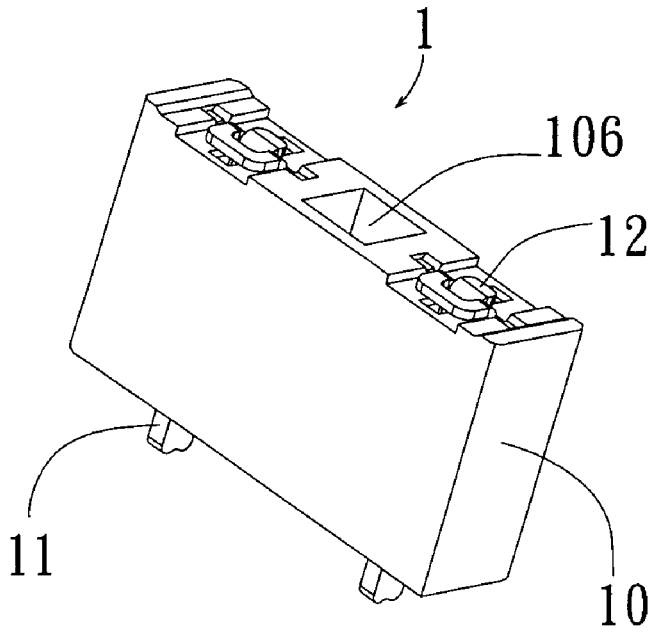
FIG. 2 is a schematic bottom elevation of the electrical connector according to the present invention.
Figure 3:
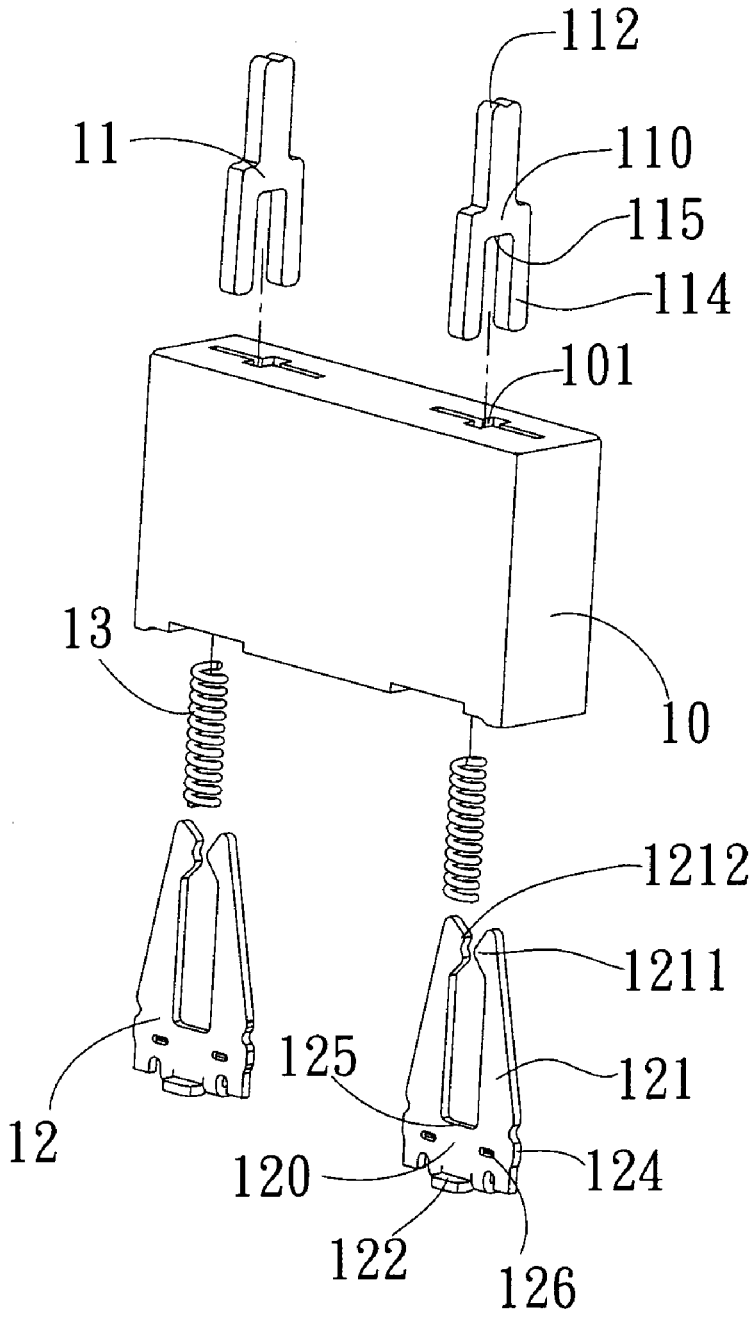
FIG. 3 is an exploded view of the electrical connector according to the present invention.
Figure 4:
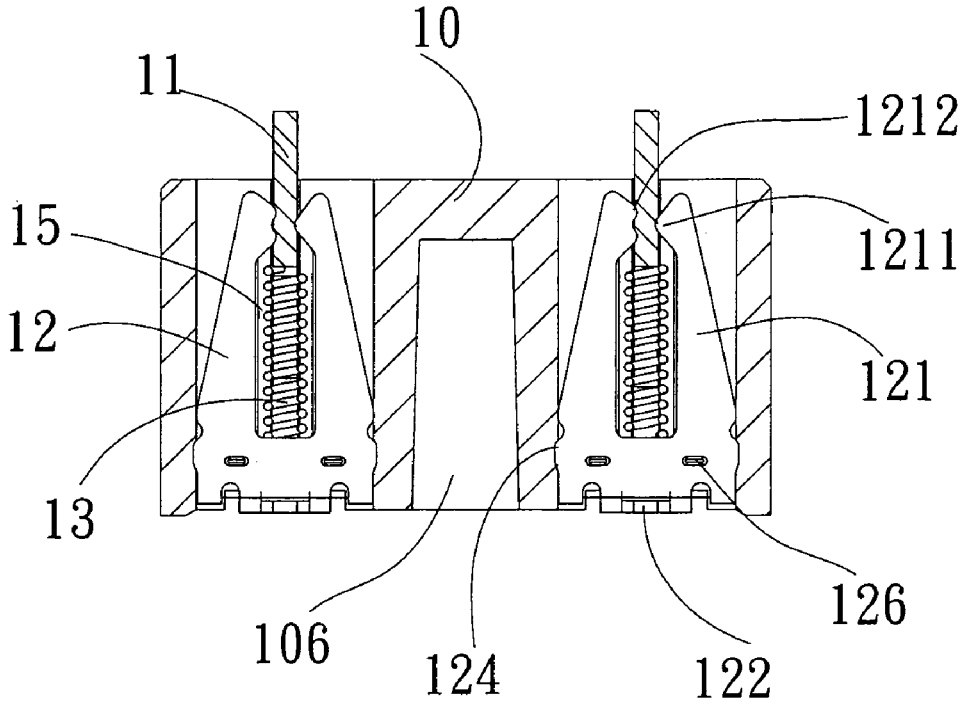
FIG. 4 is a sectional view taken along line A-A of FIG. 1.
Figure 5:
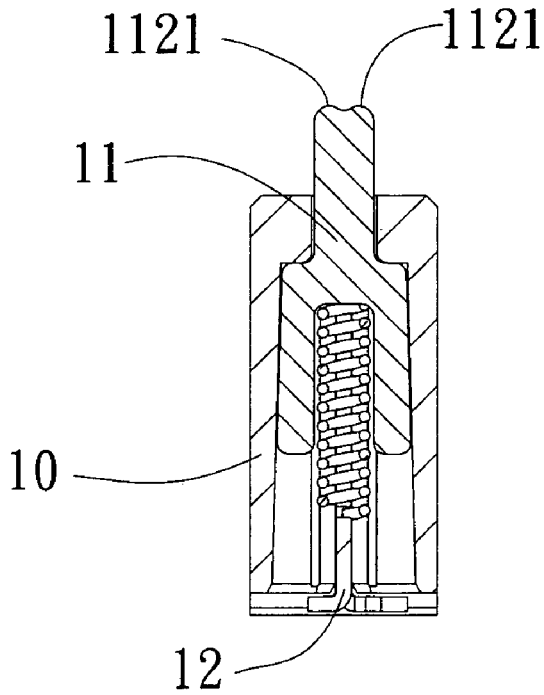
FIG. 5 is a sectional view taken along line B-B of FIG. 1.
Figure 6:
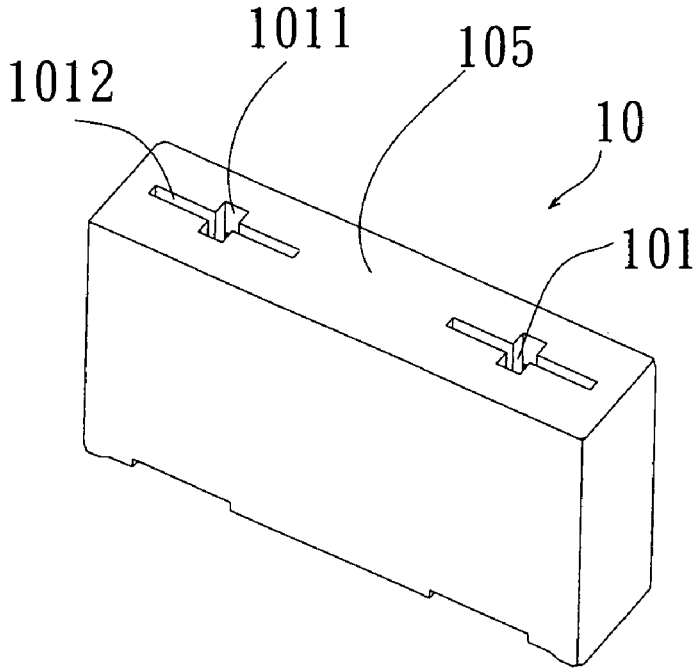
FIG. 6 is a schematic top elevation of the electrically insulative housing of the electrical connector according to the present invention.
Figure 7:
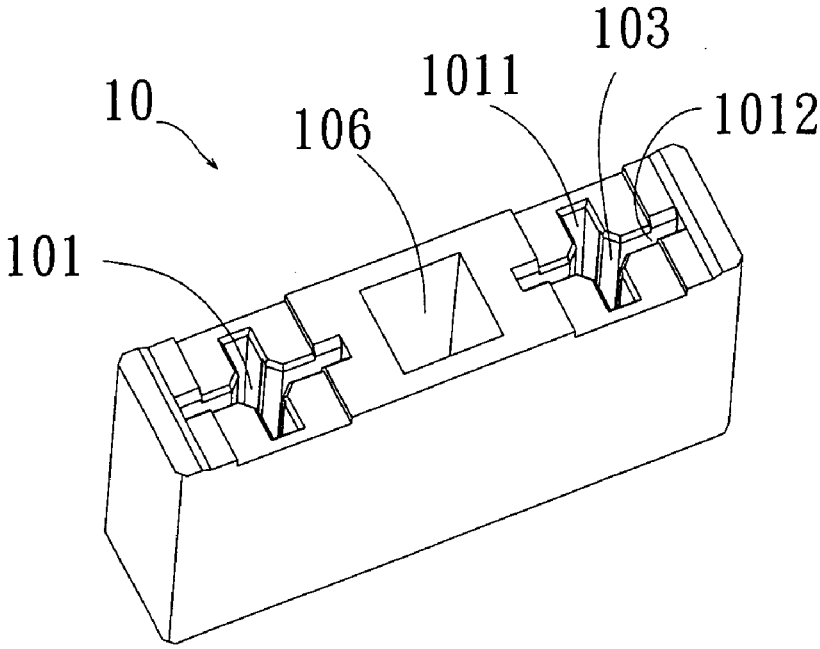
FIG. 7 is a schematic bottom elevation of the electrically insulative housing of the electrical connector according to the present invention.
Figure 8:
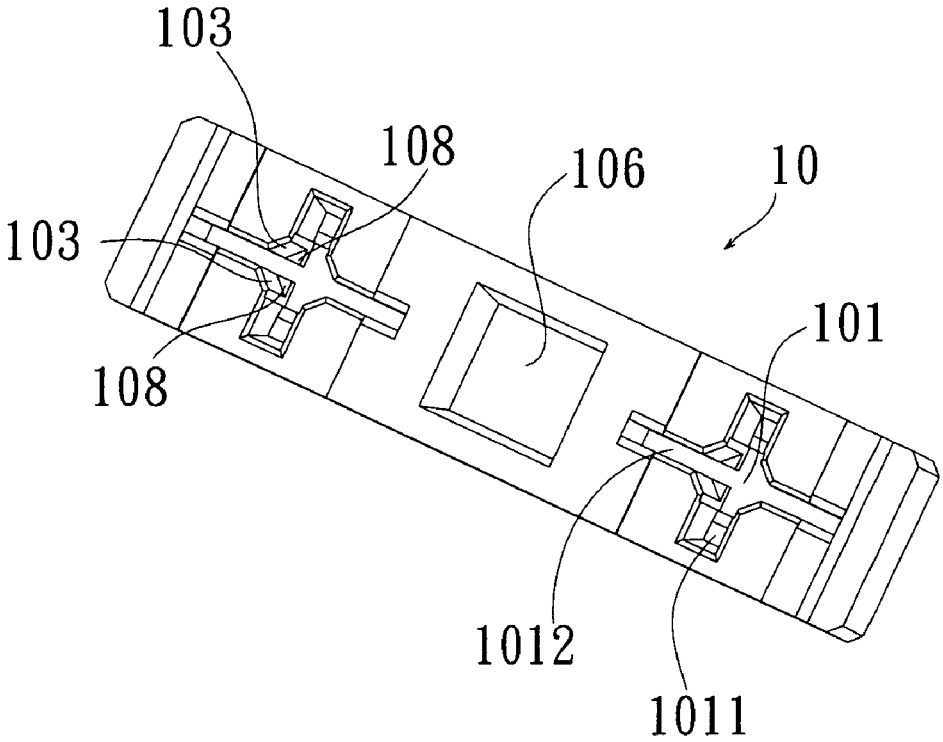
FIG. 8 is a top view of the electrically insulative housing of the electrical connector according to the present invention.

Referring to FIGS. 1~8, an electrical connector 1 in accordance with the present invention is shown for connecting two electronic members (not shown), comprising an electrically insulative housing 10, two first conducting terminals 11, two second conducting terminals 12, and two spring members 13 respectively connected between the first conducting terminals 11 and the second conducting terminals 12. Elastomers or the like may be used to substitute for the spring members 13.

The housing 10 has two terminal slots 101 extending through the top and bottom sides. The terminal slots 101 can be but not limited to crossed slots, each having a first slot 1011 and a second slot 1012 intersected with the first slot 1011. A limiter structure is provided at the intersected wall area between the first slot 1011 and the second slot 1012. According to this embodiment, the limiter structure comprises a chamfered edge 103 at each of the four corners between the first slot 1011 and the second slot 1012. The chamfered edge 103 can be a flat surface (if circularly chamfered, the limiter is a curved surface). The chamfered edge 103 can be eliminated. In this case, the limiter structure can be the rhombic angle at each corner in the intersected area between the first slot 1011 and the second slot 1012, showing a "*"shape (not shown). Further, a locating block 108 is provided at one end of the limiter structure for the positioning of the spring members.

Further, the housing 10 has a flat top surface 105 on the top side for the positioning of a vacuum mount of an automatic installation machine so that the electrical connector 1 can quickly be connected to a matching electronic member by the automatic installation machine, and an access hole 106 extending to the bottom side between the two terminal slots 101.

The first conducting terminals 11 are made of red bronze of purity over 95% for the advantage of high conductivity over 70% IACS. Each first conducting terminal 11 has a base 110, a top contact shank 112 perpendicularly extending from the top side of the base 110 on the middle, and two bottom arms 114 perpendicularly and bilaterally extending from the bottom side of the base 110 opposite to the top contact shank 112. The top contact shank 112 has two recessed contact portions 1121 on its free end.

The second conducting terminals 12 are made of a copper alloy (for example, phosphor bronze) for the advantage of high resilient power. Each second conducting terminal 12 has base 120, two springy clamping arms 121 perpendicularly and bilaterally extending from the top side of the base 120 and terminating in a respective contact portion 1211 or 1212 at different elevations, and a plurality of contact fingers 122 perpendicularly extending from the bottom side of the base 120. The contact fingers 122 may be coated with a solder material for bonding to a matching electronic member evenly, so that the second conducting terminal 12 bears pressure in a balanced manner after installation.

Further, the base 120 of each second conducting terminal 12 has a retaining portion 124 at each of two opposite lateral sides thereof. When the second conducting terminal 12 is inserted into the second slot 1012 of one terminal slot 101, the two retaining portions 124 are forced into friction engagement with the peripheral wall of the second slot 1012, thereby securing the second conducting terminal 12 firmly to the associating terminal slot 101. The base 120 further has a plurality of raised portions 126 to enhance friction engagement between the respective second conducting terminal 12 and the respective terminal slot 101.

During installation, the second conducting terminal 12 are respectively inserted into the second slots 1012 of the terminal slot 101, the first conducting terminals 11 are respectively inserted into the first slots 1011 of the terminal slots 101, and an accommodation space 15 is defined between the base 110 and bottom arms 114 of each first conducting terminal 11 and the base 120 and springy clamping arms 121 of the associating second conducting terminal 12 to accommodate one of the spring members 13. When each spring member 13 received an external pressure, the top and bottom ends of each spring member 13 are respectively stopped at the bottom side of the base 110 of the associating first conducting terminal 11 and the top side of the base 120 of the associating second conducting terminal 120. When each spring member 13 is oscillated horizontally, the respective limiters 103 support the respective spring members 13 in place, preventing deformation of the spring members 13 to force the respective conducting terminals to oscillate or to deform. Further, the contact portions 1211 and 1212 of the springy clamping arms 121 of each second conducting terminal 12 are respectively stopped against two opposite sides of the base 110 of the associating first conducting terminal 11 at different elevations, maintaining electric connection between the first conducting terminal 11 and the associating second conducting terminal 12. After installation, the contact fingers 122 of the second conducting terminals 12 are electrically connected to a first external electronic member (for example, circuit board), and the contact shanks 112 of the first conducting terminals 11 are stopped at and electrically connected to a second external electronic member. When the second external electronic member is pressed on the contact shanks 112 of the first conducting terminals 11, the first conducting terminals 11 are moved vertically relative to the housing 10 against the spring members 13 and the second conducting terminals 12, therefore a reactive force is produced, causing the spring members 13 to force the first conducting terminals 11 in positive contact with the second external electronic member.

Figure 9:
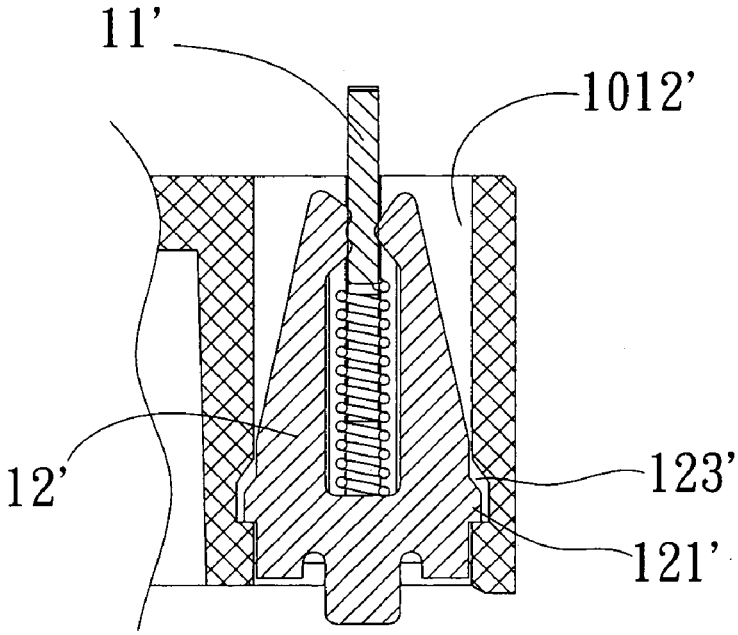
FIG. 9 is a sectional view of a part of an alternate form of the electrical connector according to the present invention.

FIG. 9 is a sectional view of a part of an alternate form of the electric connector according to the present invention. According to this embodiment, the base 120' of each second conducting terminal 12' has a sliding block 121' at each of two opposite sides thereof, and the second slot 1012' of each terminal slot 101' has two opposite sliding groove 123' that receive the sliding blocks 121' of the associating second conducting terminal 12' to guide smooth movement of the second conducting terminal 12' and the associating first conducting member 11' relative to the housing 10 in a predetermined path when the second conducting terminal 12' receives an external pressure.

As stated above, the electrical connector has a first conducting terminal and a second conducting terminal electrically connected in each terminal slot with a spring member supported between the first conducting terminal and the second conducting terminal. Further, the second conducting terminal has two springy clamping arms clamped on the first conducting terminal. The first conducting terminal is moved vertically relative to the electrically insulative housing when received an external pressure so that the electrical connector is constantly kept in contact with the matching electronic members effectively. Therefore, the invention effectively eliminates the drawbacks of the conventional design.

A prototype of electrical connector has been constructed with the features of FIGS. 1~9. The electrical connector functions smoothly to provide all of the features disclosed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electrical connector comprising an electrically insulative housing, said electrically insulative housing having a plurality of terminal slots, and a plurality of conducting terminal sets respectively mounted in said terminal slots, wherein said conducting terminal sets each comprise a first conducting terminal and a second conducting terminal mounted in one of said terminal slots at two opposite sides, said second conducting terminal having two springy clamping arms clamped on the associating first conducting terminals, and a spring member supported between said first conducting terminal and said second conducting terminal.

2. The electrical connector as claimed in claim 1, wherein the first conducting terminal of each of said conducting terminal sets has a width set in the associating terminal slot in a first direction, and the second conducting terminal of each of said conducting terminal sets has a width set in the associating terminal slot in a second direction that extends across said first direction.

3. The electrical connector as claimed in claim 1, wherein the second conducting terminal of each of said conducting terminal sets has a base and a plurality of contact fingers respectively extending from a bottom side of the base for connection to an external electronic member.

4. The electrical connector as claimed in claim 1, wherein said electrically insulative housing has a flat surface on one side thereof through which said terminal slots extend.

5. The electrical connector as claimed in claim 1, wherein the first conducting terminal of each of said conducting terminal sets has a base, a contact shank perpendicularly upwardly extending from one side of the base, and two bottom arms perpendicularly and bilaterally extending from an opposite side of the base toward the associating second conducting terminal.

6. The electrical connector as claimed in claim 5, wherein the contact shank of the first conducting terminal of each of said conducting terminal sets has at least one contact portion for the contact of an external electronic member.

7. The electrical connector as claimed in claim 1, wherein the second conducting terminal of each of said conducting terminal sets has a base, and the two springy clamping arms of the second conducting terminal of each of said conducting terminal sets are perpendicularly and bilaterally extending from one side of the base toward the associating first conducting terminal.

8. The electrical connector as claimed in claim 7, wherein the springy clamping arms of the second conducting terminal of each of said conducting terminal sets each have a contact portion disposed in contact with the associating first conducting terminal.

9. The electrical connector as claimed in claim 8, wherein the contact portions of the springy clamping arms of the second conducting terminal of each of said conducting terminal sets are disposed at different elevations.

10. An electrical connector comprising an electrically insulative housing, said electrically insulative housing having a plurality of terminal slots, and a plurality of conducting terminal sets respectively mounted in said terminal slots, wherein said conducting terminal sets each comprise a first conducting terminal and a second conducting terminal mounted in one of said terminal slots at two opposite sides, said second conducting terminal having two springy clamping arms clamped on the associating first conducting terminals, and an elastomer supported between said first conducting terminal and said second conducting terminal.

11. The electrical connector as claimed in claim 10, wherein the first conducting terminal of each of said conducting terminal sets has a width set in the associating terminal slot in a first direction, and the second conducting terminal of each of said conducting terminal sets has a width set in the associating terminal slot in a second direction that extends across said first direction.

12. The electrical connector as claimed in claim 10, wherein the second conducting terminal of each of said conducting terminal sets has a base and a plurality of contact fingers respectively extending from a bottom side of the base for connection to an external electronic member.

13. The electrical connector as claimed in claim 10, wherein the first conducting terminal of each of said conducting terminal sets has a base, a contact shank perpendicularly upwardly extending from one side of the base, and two bottom arms perpendicularly and bilaterally extending from an opposite side of the base toward the associating second conducting terminal.

14. The electrical connector as claimed in claim 13, the contact shank of the first conducting terminal of each of said conducting terminal sets has at least one contact portion for the contact of an external electronic member.

15. The electrical connector as claimed in claim 10, wherein the second conducting terminal of each of said conducting terminal sets has a base, and the two springy clamping arms of the second conducting terminal of each of said conducting terminal sets are perpendicularly and bilaterally extending from one side of the base toward the associating first conducting terminal.

16. The electrical connector as claimed in claim 15, wherein the springy clamping arms of the second conducting terminal of each of said conducting terminal sets each have a contact portion disposed in contact with the associating first conducting terminal.

17. The electrical connector as claimed in claim 16, wherein the contact portions of the springy clamping arms of the second conducting terminal of each of said conducting terminal sets are disposed at different elevations.

18. An electrical connector comprising an electrically insulative housing, said electrically insulative housing having a plurality of terminal slots, and a plurality of conducting terminal sets respectively mounted in said terminal slots, wherein said conducting terminal sets each comprise a first conducting terminal and a second conducting terminal mounted in one of said terminal slots at two opposite sides and disposed in contact with each other, said first conducting terminal and said second conducting terminal being made of two different metal materials, and a spring member supported between said first conducting terminal and said second conducting terminal.

19. The electrical connector as claimed in claim 18, wherein the first conducting terminal of each of said conducting terminal sets is made of a first metal material that has a relatively higher conductivity that the second conducting terminal of each of said conducting terminal sets.

20. The electrical connector as claimed in claim 18, wherein the conductivity of the first conducting terminal of each of said conducting terminal sets is above 70% IACS.

21. The electrical connector as claimed in claim 18, wherein the first conducting terminal of each of said conducting terminal sets is made of red bronze.

22. The electrical connector as claimed in claim 18, wherein the second conducting terminal of each of said conducting terminal sets is made of a resilient metal material.

23. The electrical connector as claimed in claim 18, wherein the second conducting terminal of each of said conducting terminal sets is made of a copper alloy.

24. The electrical connector as claimed in claim 18, wherein the first conducting terminal of each of said conducting terminal sets has a width set in the associating terminal slot in a first direction, and the second conducting terminal of each of said conducting terminal sets has a width set in the associating terminal slot in a second direction that extends across said first direction.

25. The electrical connector as claimed in claim 18, wherein the second conducting terminal of each of said conducting terminal sets has a base and a plurality of contact fingers respectively extending from a bottom side of the base for connection to an external electronic member.

26. The electrical connector as claimed in claim 18, wherein the second conducting terminal of each of said conducting terminal sets has a base and two springy clamping arms perpendicularly and bilaterally extending from the base and clamped on two opposite sides of the associating first conducting terminal.

27. The electrical connector as claimed in claim 26, wherein the springy clamping arms of the second conducting terminal of each of said conducting terminal sets each have a contact portion disposed in contact with the associating first conducting terminal.

28. The electrical connector as claimed in claim 27, wherein the contact portions of the springy clamping arms of the second conducting terminal of each of said conducting terminal sets are disposed at different elevations.

29. The electrical connector as claimed in claim 18, wherein the first conducting terminal of each of said conducting terminal sets has a base, a contact shank perpendicularly upwardly extending from one side of the base, and two bottom arms perpendicularly and bilaterally extending from an opposite side of the base toward the associating second conducting terminal.

30. The electrical connector as claimed in claim 29, wherein the contact shank of the first conducting terminal of each of said conducting terminal sets has at least one contact portion for the contact of an external electronic member.

31. An electrical connector comprising an electrically insulative housing, said electrically insulative housing having a plurality of terminal slots, and a plurality of conducting terminal sets respectively mounted in said terminal slots, said conducting terminal sets each comprising a first conducting terminal and a second conducting terminal mounted in one of said terminal slots at two opposite sides and disposed in contact with each other and a spring member supported between said first conducting terminal and said second conducting terminal, wherein said electrically insulative housing has a plurality of limiters respectively provided inside said terminal slots to support the associating spring members in said terminal slots.

32. The electrical connector as claimed in claim 31, wherein said terminal slots each have a cross-shaped cross section.

33. The electrical connector as claimed in claim 31, wherein said limiters each are formed of a flat surface in the associating terminal slot.

34. The electrical connector as claimed in claim 31, wherein said limiters each are formed of a curved surface in the associating terminal slot.

35. The electrical connector as claimed in claim 31, wherein said limiters each are formed of a chamfered edge in the associating terminal slot.

36. The electrical connector as claimed in claim 31, wherein said limiters each have a locating block at one end.

37. The electrical connector as claimed in claim 31, wherein the spring member in each of said terminal slots is stopped against the associating limiters in the associating terminal slot when received an external pressure.

38. The electrical connector as claimed in claim 31, wherein the second conducting terminal of each of said conducting terminal sets has a base and a plurality of contact fingers perpendicularly extending from one side of the base opposite to the associating first conducting terminal for connection to an external electronic member.

39. The electrical connector as claimed in claim 31, wherein the first conducting terminal of each of said conducting terminal sets has a base, a contact shank perpendicularly upwardly extending from one side of the base of the associating first conducting terminal, and two bottom arms perpendicularly and bilaterally extending from an opposite side of the base toward the associating second conducting terminal; the second conducting terminal of each of said conducting terminal sets has a base and two springy clamping arms perpendicularly and bilaterally extending from one side of the base of the associating second conducting terminal and clamped on the associating first conducting terminal.

40. The electrical connector as claimed in claim 39, wherein the contact shank of the first conducting terminal of each of said conducting terminal sets has at least one contact portion for the contact of an external electronic member.

41. The electrical connector as claimed in claim 39, wherein the two springy clamping arms of the second conducting terminal of each of said conducting terminal sets each have a contact portion respectively disposed in contact with the base of the associating first conducting terminal.

42. The electrical connector as claimed in claim 41, wherein the contact portions of the two springy clamping arms of the second conducting terminal of each of said conducting terminal sets are disposed at different elevations.

43. An electrical connector comprising an electrically insulative housing, said electrically insulative housing having a plurality of terminal slots, and a plurality of conducting terminal sets respectively mounted in said terminal slots, said conducting terminal sets each comprising a first conducting terminal and a second conducting terminal mounted in one of said terminal slots at two opposite sides and disposed in contact with each other and a spring member supported between said first conducting terminal and said second conducting terminal, wherein the first conducting terminal of each of said conducting terminal sets has a width set in the associating terminal slot in a first direction; the second conducting terminal of each of said conducting terminal sets has a width set in the associating terminal slot in a second direction that extends across said first direction; the first conducting terminal of each of said conducting terminal sets defines with the associating second conducting terminal an accommodation space, which accommodates the associating spring member.

44. The electrical connector as claimed in claim 43, wherein the base of the first conducting terminal of each of said conducting terminal sets define with the base of the associating second conducting terminal the associating accommodation space.

45. The electrical connector as claimed in claim 43, wherein the first conducting terminal of each of said conducting terminal sets has a base, a contact shank perpendicularly upwardly extending from one side of the base of the associating first conducting terminal, and two bottom arms perpendicularly and bilaterally extending from an opposite side of the base toward the associating second conducting terminal; the second conducting terminal of each of said conducting terminal sets has a base and two springy clamping arms perpendicularly and bilaterally extending from one side of the base of the associating second conducting terminal and clamped on the associating first conducting terminal.

46. The electrical connector as claimed in claim 45, wherein the spring member of each of said conducting terminal sets has a top end stopped at the base of the associating first conducting member and a bottom end stopped at the base of the associating second conducting member.

47. The electrical connector as claimed in claim 45, wherein the contact shank of the first conducting terminal of each of said conducting terminal sets has at least one contact portion for the contact of an external electronic member.

48. The electrical connector as claimed in claim 45, wherein the two springy clamping arms of the second conducting terminal of each of said conducting terminal sets each have a contact portion respectively disposed in contact with the base of the associating first conducting terminal.

49. The electrical connector as claimed in claim 48, wherein the contact portions of the two springy clamping arms of the second conducting terminal of each of said conducting terminal sets are disposed at different elevations.

50. The electrical connector as claimed in claim 43, wherein the second conducting terminal of each of said conducting terminal sets has a base and a plurality of contract fingers perpendicularly extending from a bottom side of the base for connection to an external electronic member.

51. The electrical connector as claimed in claim 50, wherein said contact fingers are covered with a solder material.

* * * * *